United States Patent [19]

Ayala

[11] Patent Number: 5,026,018

[45] Date of Patent: Jun. 25, 1991

[54] APPARATUS FOR FORMING RISERS FOR CONCRETE STEPS

[76] Inventor: Harry J. Ayala, 4023 E. Burgess La., Phoenix, Ariz. 85040

[21] Appl. No.: 484,919

[22] Filed: Feb. 26, 1990

[51] Int. Cl.[5] ..... E04G 13/06

[52] U.S. Cl. ..... 249/14; 249/2; 249/19; 249/157; 249/208

[58] Field of Search ..... 249/2, 6, 14, 19, 157, 249/189, 192, 208, 219.1; 248/200.1, 257

[56] References Cited

U.S. PATENT DOCUMENTS

| | | | |
|---|---|---|---|
| 2,306,722 | 12/1942 | Fox | 249/14 |
| 2,386,161 | 10/1945 | Hawes | 248/200.1 |
| 2,863,207 | 12/1958 | Davis et al. | 249/14 |
| 3,014,685 | 12/1961 | Jensen et al. | 249/14 |

FOREIGN PATENT DOCUMENTS

| | | | |
|---|---|---|---|
| 2411423 | 1/1975 | Fed. Rep. of Germany | 249/14 |
| 3430539 | 2/1986 | Fed. Rep. of Germany | 249/14 |
| 3440828 | 5/1986 | Fed. Rep. of Germany | 249/219.1 |

*Primary Examiner*—James C. Housel

*Attorney, Agent, or Firm*—Jack C. Munro

[57] ABSTRACT

An apparatus for forming risers for concrete steps between a pair of spaced vertical walls. The apparatus takes the form of a bracket which is to connect with a length of wood such as a conventional 2×6. A threaded member associated with the bracket in threading movement causes the bracket to extend from the 2×6 to produce a clamping of the 2×6 in the bracket between the spaced vertical walls. As a result, a removable barrier is formed which is to contain concrete when it is poured. After sufficient drying of the concrete, the 2×6 and the bracket are removed from the vertical side walls leaving the now produced concrete step.

2 Claims, 1 Drawing Sheet

APPARATUS FOR FORMING RISERS FOR CONCRETE STEPS

BACKGROUND OF THE INVENTION

The field of this invention relates to the construction industry and more particularly to a piece of equipment to facilitate the forming of concrete steps which are commonly poured between a pair of spaced vertical walls.

Within the construction industry, forming of concrete steps is exceedingly common. The typical method of construction for concrete steps is to first form the side walls which are located parallel to one another and spaced apart the desired amount of the width of the risers which will form the steps. There generally is a back wall for the risers which will act as a barrier for the concrete along the back surface of the risers. It is necessary to form a barrier for the concrete along the front surface of the risers. It is common to form this barrier by the mounting of an elongated section of wood such as a 2×6 between the spaced walls in the area which will define the front surface of the riser. For each riser, such a piece of wood is so located. Each piece of wood is held in place by brackets which are nailed or otherwise physically secured to the pieces of wood and in turn nailed to the spaced side walls.

After the concrete is poured and hardened, it is necessary to remove these pieces of wood and the associated brackets. This removement procedure is not particularly easy since the brackets have been nailed to the wood and the brackets have also been nailed to the side wall. However, after a certain amount of effort, each section of wood and its bracket is removed. However, there is now nail holes formed within each side wall and possibly also within each newly formed riser. Patching of these nail holes is now necessary. This patching, when completed, can normally be observed thereby detracting from the overall appearance of the resultingly formed step.

SUMMARY OF THE INVENTION

The primary objective of the present invention is to construct a form for a riser for a concrete step in which the form can be installed in position without the application of any penetrating form of fastener which diminishes the overall appearance of the resultingly formed step.

Another objective of the present invention is to provide a form for a riser for a series of concrete steps wherein each form can be quickly and easily installed and quickly and easily removed when such is desired.

Another objective of the present invention is to construct a form for a concrete step which can be manufactured at a relatively low cost and thereby sold to the user at also a relatively low cost.

The structure of the present invention utilizes a bracket which has an internal chamber, one end of which is closed by an end plate and the opposite end of which is open. Within the open end is telescopingly mounted in a close fitting manner one end of a 2×6 or other similar piece of wood. Within the internal chamber and connected to the end plate is a threaded rod. On the threaded rod is a nut. One end of the 2×6 abuts against the nut and rotation of the nut will cause the end plate to move outward away from the end of the 2×6. Therefore, if the 2×6 is the proper length so that when the combination of the bracket and the 2×6 are inserted in position, there will only be a small gap remaining which can be eliminated by tightening of the nut resulting in clamping of the 2×6 and the bracket in a fixed position between the vertically oriented, spaced apart side walls. Using a plurality of risers will result in the forming of a plurality of concrete steps.

DETAILED DESCRIPTION OF THE SHOWN EMBODIMENT

Figure 1:
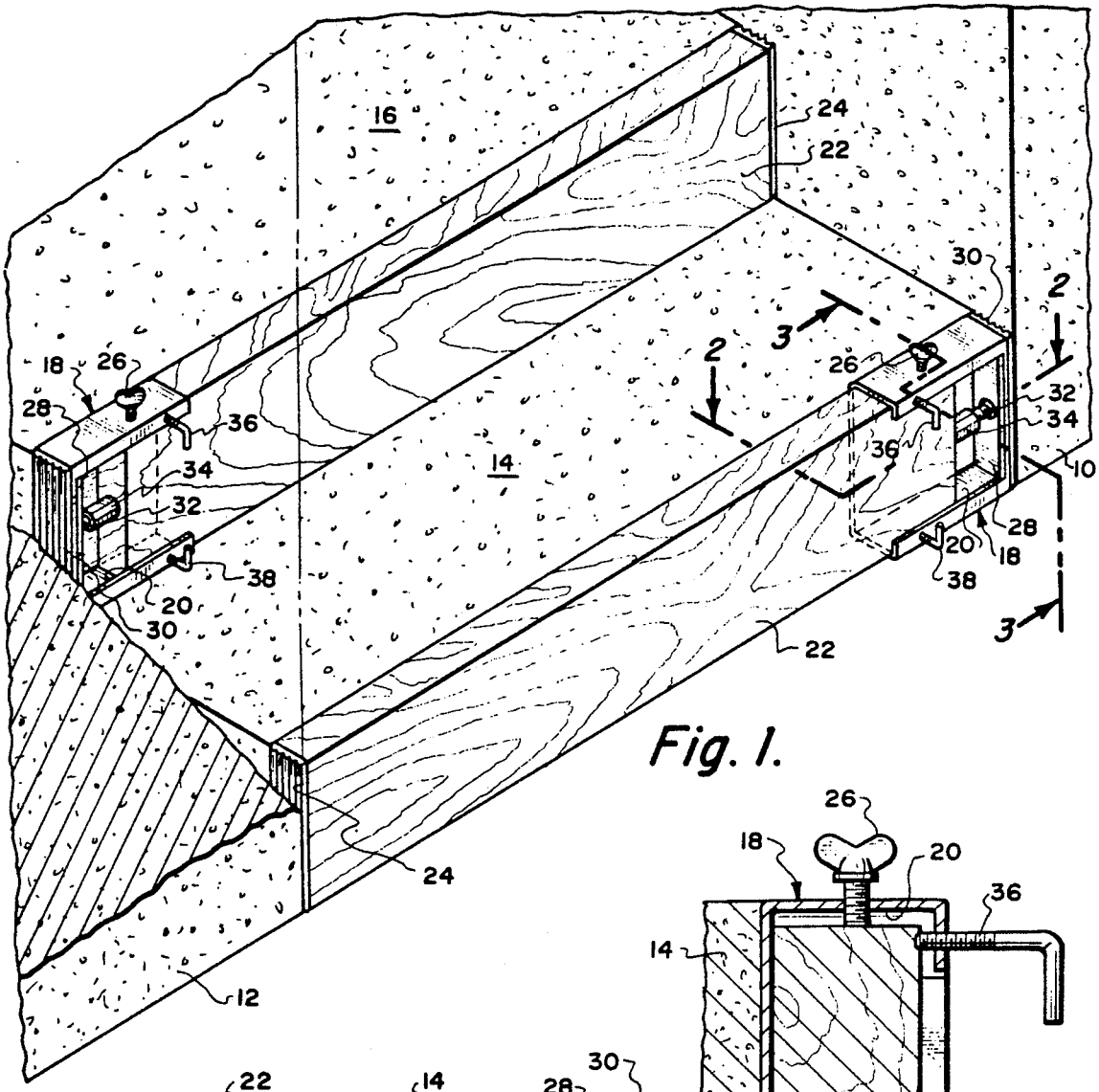
FIG. 1 is an isometric view showing a pair of the apparatuses of the present invention which are mounted in position between a pair of spaced apart side walls and concrete has been poured to form the risers of the resultingly formed steps.
Figure 2:
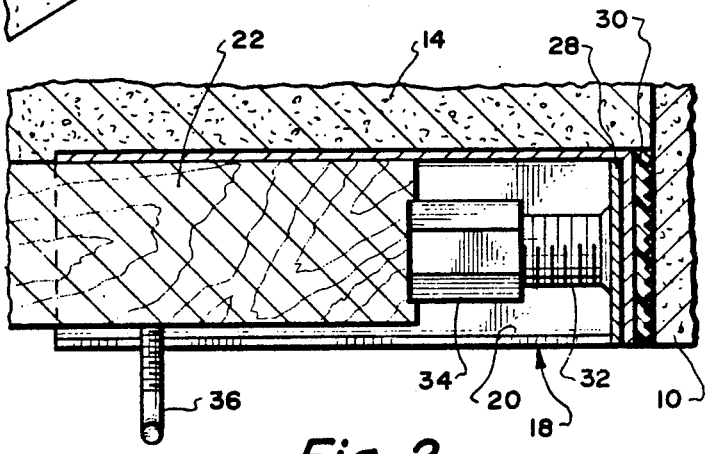
FIG. 2 is a cross-sectional view taken along line 2—2 of FIG. 1.
Figure 3:
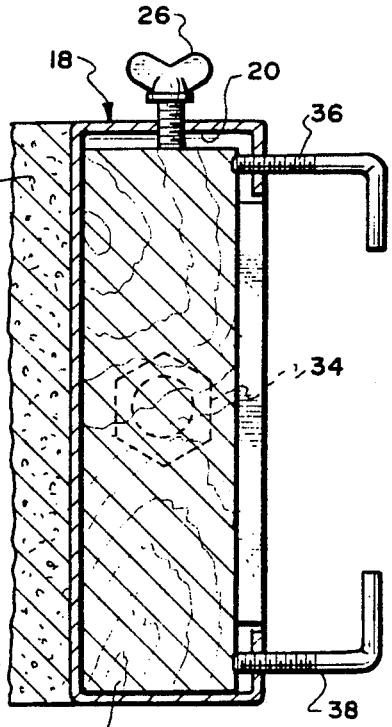
FIG. 3 is a cross-sectional view taken along line 3—3 of FIG. 1.

Referring particularly to the drawing, there is shown a pair of side walls 10 and 12. These side walls 10 and 12 are similar in size and appearance and are located in a parallel spaced apart manner defining a space therebetween. It is desirable to form risers such as risers 14 and 16 within this space. These risers are poured from concrete and therefore some form of a barrier has to be provided along the front surface of each riser 14 and 16 so as to hold the concrete in position until such hardens.

In order to hold back concrete, there is to be utilized the apparatus 18 of the present invention. The apparatus 18 takes the form of a bracket having an internal chamber 20. The upper and lower walls of the internal chamber 20 are formed by the channels which are to function as a guide to confine in position one end of an elongated rigid member 22 to prevent lateral disconnection of the member 22 from the bracket 18. However, the member 22 is capable of being moved longitudinally within the internal chamber 20. A typical structure for the member 22 would be a conventional length of wood such as a 2×6 or 2×8.

The length of the member 22 is noted to be slightly less than the spacing between the walls 10 and 12. The end of the member 22 that is not connected to the bracket 18 has mounted thereon a resilient pad 24. This pad 24 can be mounted by adhesive or by some form of conventional fastening means such as a nail or stapled to the member 22. This pad 24 is to abut against the side wall 12.

It is possible that the member 22 will not closely conform within the internal chamber 20. If the member 22 is somewhat loose within the internal chamber 20, this looseness is to be taken up through the use of a wing nut 26. The wing nut 26 is threadably mounted within a side edge of the bracket 18. Tightening of the wing nut 26 is to apply pressure against the member 22 thereby eliminating any excessive movement between the bracket 18 and the member 22.

The bracket 18 has an end plate 28. Exteriorly mounted on the end plate 28 is a resilient pad 30. This resilient pad 30 is to abut against the side wall 10. Mounted within the internal chamber 20 and welded, or otherwise fixedly secured, to the end plate 28 is a threaded member 32. Mounted on the threaded member 32 is a nut 34. The outer end of the nut 34 is to abut against the end of the member 22 that is located within the internal chamber 20.

Rotational extending movement of the nut 34 relative to the threaded member 32 causes the entire bracket 18 to be moved relative to the member 22. This movement is to cause the end plate 28 to become spaced further from the member 22. Normally, when it is initially installed, the nut 34 is moved to substantially enclose the threaded member 32. As the nut 34 is rotated relative to threaded member 32, the overall combined length of the member 22 and the bracket 18 is increased. If the initial length of the member 22 and the bracket 18 is selected so as to be just slightly less than the space between the side walls 10 and 12, then the extension of the bracket 18 relative to member 22 will result in a clamping action occurring to the side walls 10 and 12. This clamping action will result in the bracket 18 and member 22 to be tightly fixed in position between the side walls 10 and 12. Once so fixed in position, the risers 14 and 16 can then be poured. Once the risers 14 and 16 harden, it is only necessary to loosen the nuts 34 which will cause the end plate 28 to move closer to the rigid member 22 releasing the clamping action between the walls 10 and 12. At that time the bracket 18 and its rigid member 22 can then be removed.

At times, when the clamping action is established (prior to pouring the risers 14 and 16), it may be desirable to further apply a solid securement between the bracket 18 and the member 22. In order to do this, the wing nuts 36 and 38 are tightened which are threadably mounted within the bracket 18. Tightening of the wing nuts 36 and 38 forces the inner end of these wing nuts into direct physical embedding contact with the member 22. During the disengagement procedure of the apparatus of this invention, it will be necessary to move the wing nuts 36 and 38 to a released position so that the bracket 18 will slidingly move relative to the member 22.

What is claimed is:

1. An apparatus for forming risers for concrete steps poured between a pair of spaced vertical walls, said apparatus comprising:

an elongated rigid member having a fixed length less than the spacing between said vertical walls, said elongated rigid member having a first end and a second end, said elongated rigid member having a longitudinal center axis;

a bracket having an internal chamber, said first end being telescopingly received within said internal chamber, said bracket being slidably movable on said elongated rigid member in a direction parallel to said center axis, guide means on said bracket preventing movement of said bracket relative to said rigid member transverse to said longitudinal center axis, said bracket having an end plate, said end plate abutting against one of said walls with said second end of said elongated rigid member abutting against the other said wall;

a threaded member located in said internal chamber, said threaded member located between said end plate and said first end of said elongated rigid member, a nut threadedly mounted on said threaded member, rotation of said nut in one direction on said threaded member causes moving of said end plate away from said elongated rigid member tightly clamping said elongated rigid member and said bracket between said vertical walls; and said elongated rigid member closely conforming to the interior wall surface of said internal chamber, adjustment means mounted on said bracket, said adjustment means for laterally adjusting the size of said internal chamber to insure that there is a close fit between said elongated rigid member and said bracket since various widths of said elongated rigid member may be utilized.

2. The apparatus as defined in claim 1 wherein: fixing means mounted on said bracket, said fixing means securing together said elongated rigid member and said bracket when said bracket and said elongated rigid member are clamped between said vertical walls.

* * * * *